US008813918B2

(12) United States Patent
Kocher et al.

(10) Patent No.: US 8,813,918 B2
(45) Date of Patent: Aug. 26, 2014

(54) METHOD AND DEVICE FOR MONITORING AN ELEVATOR SUPPORT CHARACTERIZING PROPERY

(75) Inventors: Hans Kocher, Udligenswil (CH); Mirco Annen, Kussnacht am Rigi (CH); Roger Limacher, Zug (CH)

(73) Assignee: Inventio AG, Hergiswil (CH)

( * ) Notice: Subject to any disclaimer, the term of this patent is extended or adjusted under 35 U.S.C. 154(b) by 519 days.

(21) Appl. No.: 13/139,666

(22) PCT Filed: Dec. 4, 2009

(86) PCT No.: PCT/EP2009/066455

§ 371 (c)(1),
(2), (4) Date: Jun. 14, 2011

(87) PCT Pub. No.: WO2010/072549

PCT Pub. Date: Jul. 1, 2010

(65) Prior Publication Data

US 2011/0253487 A1 Oct. 20, 2011

(30) Foreign Application Priority Data

Dec. 22, 2008 (EP) ..... 08172489

(51) Int. Cl.
*B66B 1/34* (2006.01)

(52) U.S. Cl.
USPC ..... 187/391; 324/693

(58) Field of Classification Search
USPC ..... 187/247, 248, 316–317, 284, 291, 187/391–393; 73/862.338, 862.68; 324/71.2, 691, 693, 71.1
See application file for complete search history.

(56) References Cited

U.S. PATENT DOCUMENTS

| | | | | |
|---|---|---|---|---|
| 3,973,648 | A * | 8/1976 | Hummert et al. | 187/393 |
| 4,467,895 | A * | 8/1984 | Smith et al. | 187/391 |
| 4,930,604 | A * | 6/1990 | Schienda et al. | 187/393 |
| 5,731,528 | A * | 3/1998 | Yamazaki et al. | 73/862.41 |
| 6,123,176 | A * | 9/2000 | O'Donnell et al. | 187/393 |
| 6,330,936 | B1 * | 12/2001 | Lence Barreiro et al. | 187/393 |
| 6,516,923 | B2 * | 2/2003 | Lence Barreiro et al. | 187/391 |
| 6,604,611 | B2 * | 8/2003 | Liu et al. | 187/391 |
| 6,863,161 | B2 * | 3/2005 | Mearns et al. | 187/391 |
| 7,123,030 | B2 * | 10/2006 | Robar et al. | 324/693 |
| 8,011,479 | B2 * | 9/2011 | Stucky et al. | 187/393 |
| 8,424,653 | B2 * | 4/2013 | Stucky et al. | 187/393 |
| 2011/0253487 | A1 * | 10/2011 | Kocher et al. | 187/393 |

FOREIGN PATENT DOCUMENTS

| | | | |
|---|---|---|---|
| DE | 3934654 | A1 | 5/1991 |
| EP | 0731209 | A1 | 9/1996 |
| EP | 1275608 | A1 | 1/2003 |
| EP | 1818444 | A1 | 8/2007 |
| WO | 00/58706 | A2 | 10/2000 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator support monitoring device in an elevator system and a method for monitoring an elevator support characterizing property, preferably an electrical resistance, of the elevator support or of a tension support of the elevator support for a sudden change in the characterizing property. A state of the elevator support is determined by evaluating several consecutive, sudden changes in the characterizing property.

17 Claims, 7 Drawing Sheets

17 contacting unit
18 circuit head
20 monitoring device 1 elevator installation
7 car
8 counterweight
9 support means
12 elevator drive
13 drive pulley
14 deflecting roller
15 control
16 end connection
17 contacting unit
19 connecting line
20 monitoring device Fig. 3
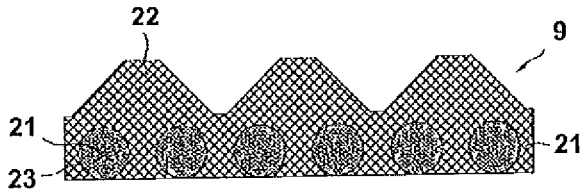
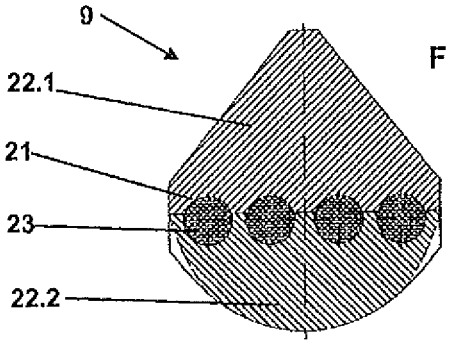
Fig. 4
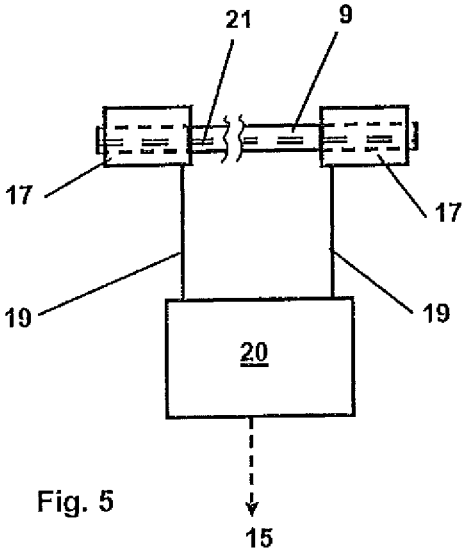
Fig. 5
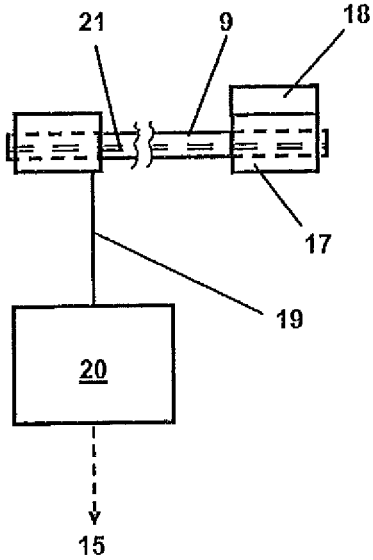
Fig. 6
17 contacting unit 20 monitoring device 17 contacting unit
18 circuit head
20 monitoring device 17 contacting unit

METHOD AND DEVICE FOR MONITORING AN ELEVATOR SUPPORT CHARACTERIZING PROPERY

FIELD OF THE INVENTION

The invention relates to an elevator support means monitoring device, to an elevator installation with a monitoring device of that kind and to a method of monitoring an elevator support means.

BACKGROUND OF THE INVENTION

The elevator support means monitoring device is fixedly installed in an elevator installation or able to be installed for temporary use. The elevator installation consists substantially of a car which is connected with a counterweight by way of the elevator support means. The car is moved along a substantially vertical car travel path by means of a drive which selectably acts on the elevator support means, directly on the car or directly on the counterweight. The car travel path is usually integrated in a shaft in a building and in that case bounded by shaft walls, shaft ceiling and shaft base. The car travel path can also be attached to a building or building structure, wherein parts of the shaft walls, shaft ceiling and shaft base are eliminated or do not have to be defined by solid materials. In this connection, the shaft then substantially corresponds with the space which is determined by the movement and arrangement of elevator components as well as by requisite safety distances and safety spaces. The shaft or the shaft walls is or are provided with accesses which selectably enable access to the car.

The elevator support means thus supports the car and the counterweight. These elevator support means are frequently not only subjected to supporting forces, but also transmit, for example by means of traction, a drive force from the drive to the car or the counterweight.

The elevator support means are frequently provided with load-bearing tension carriers which are enclosed by a traction-optimizing casing. The elevator support means is subjected to wear and abrasion. Elevator support means accordingly have to be monitored with respect to the length of use thereof so as to preclude failure of the elevator support means or to be able to replace the elevator support means in good time.

Monitoring methods of that kind can be carried out manually, for example by visual checking. However, the elevator support means can also be provided with optical wear markings such as disclosed in, for example, EP 1275608.

Other methods provide a magnetoinductive check such as proposed by, for example, Prof. Dr. Ing. K. Feyrer in his publication with respect to measuring and monitoring of running wire cables, ISBN 3-8169-1481-0; Chapter 7. Many other methods are known in elevator technology. A further monitoring method, such as proposed by way of example in WO 00/58706, measures a resistance of tension carriers and correlates it with the load-bearing capability of the support means. Other methods such as disclosed in, for example, EP 0731209 use indicator strands which are admixed with the tension carriers and twisted therewith. Tearing of an indicator strand indicates increasing ageing of the support means.

SUMMARY OF THE INVENTION

An object of the invention is to provide a monitoring method for monitoring elevator support means, which enables a statement with respect to the current state of an elevator support means and, if required, an evaluation of this state.

In this regard, at least one characterizing property of an elevator support means or a tension carrier of an elevator support means is monitored preferably by way of an elevator support means monitoring device and abrupt or discrete changes in this characterizing property are detected. Moreover, a state of the elevator support means is determined by way of evaluation of several successive abrupt changes in this characterizing property.

A support means or the tension carriers thereof has or have typical characterizing properties. A typical property of that kind can be, for example, an electrical resistance, a light conductance property or a sound transmission behavior, etc. A disturbance in the tension carrier or in the support means has an influence on this characterizing property. Thus, for example, breakage of an individual wire of a tension carrier changes an electrical resistance, which produces an abrupt change in the overall resistance of the individual carrier. This abrupt change is detected and counted as a discrete or abrupt change in the characterizing property of the tension carrier. Detection of the number of abrupt changes thus makes possible a statement about the state of the tension carrier or the support means.

The state of the elevator support means is advantageously determined on the basis of a sum [N] of the abrupt changes in the characterizing property. Alternatively or additionally the state of the elevator support means is determined on the basis of a frequency [dN/dt] of the abrupt changes in the characterizing property. In a further alternative or additional embodiment the state of the elevator support means is determined, preferably in the elevator supports monitoring device, on the basis of a change over time in the frequency [dN/dt/dt] of the abrupt changes in the characterizing property.

The detection of the sum [N] of the abrupt changes in the characterizing property enables an estimation of the individual changes, which have taken place, in the tension carrier or in the elevator support means and correspondingly makes possible estimation of the state of the support means when the number of changes is placed in relation to a statistically possibly acceptable number of individual changes.

The detection of the frequency [dN/dt] of the abrupt changes in the characterizing property enables recognition of a frequency of individual changes in the tension carrier or in the elevator support means. A frequency can indicate that an increasing fatiguing of a tension carrier material takes place, but can also indicate that a mode of operation of the elevator has changed. Changes of that kind can be increased transported load or similar.

Advantageously, a frequency evaluation is set up with consideration of an actual operating period. Thus, the evaluation over time [dN/dt/dt] is advantageously carried out over the actual operating time.

The detection of the change over time of the frequency [dN/dt/dt] of the abrupt changes in the characterizing property enables, in particular, rapid recognition of an increase in the frequency of breakage. An increase of that kind indicates that a load is distributed to an increasingly smaller load-bearing proportion of tension carriers and an increasing ageing of the material is possibly present.

Advantageously, the state of the elevator support means determined in that manner can be interrogated in the elevator support means monitoring device. Alternatively or additionally, the determined state of the elevator support means can be directly indicated by the elevator support means monitoring device. In a further alternative or supplementing construction the determined state of the elevator support means is communicated by the elevator support means monitoring device to a central elevator control. In another alternative or supplementing embodiment the elevator support means monitoring device on reaching a limit value state triggers an alarm and/or directly activates a safety device.

Thus, an exchange of support means or if need be a detailed investigation, for example by means of magnetoinductive measuring methods or by means of ultrasound, etc., can be planned appropriately to need.

The abrupt change in the characterizing property is advantageously ascertained by means of detection of a relative change between a first and a second elevator support means or between a first and a second tension carrier of the elevator support means.

Several tension carriers can thus be directly measured. In this regard it is not required for a change to be associated with an individual tension carrier. The changes are evaluated overall by way of the tension carriers integrated in the measuring circuit.

In an advantageous embodiment the elevator support means employed or the tension carrier, which is employed, of the elevator support means includes electrically conductive wires. This construction is frequently encountered. The wires are combined to form a wire bundle. The elevator support means or the tension carrier, which is employed, of the elevator support means is designed to be able to transmit tension forces and the characterizing property of the elevator support means or of the tension carrier is advantageously an electrical resistance.

Measures for filtering ascertained changes are advantageously provided. A measurement signal is subject to external influences. Thus, signal interferences naturally arise in the course of operation of an elevator installation. Filters which reduce signal interferences or background noise of the signal are provided in the proposed embodiment variants. Advantageously, the elevator support means monitoring device includes a device for filtering the detected deviations. This filtering is, for example, earthing or grounding of the two ends of the support means or the tension carrier. The grounding is carried out, for example, by way of a grounding resistance which is high by comparison with the internal resistance of the elevator support means or of the tension carrier.

Advantageously, the elevator support means comprises several tension carriers and these tension carriers are divided up into two or paired tension carrier zones. The tension carriers of a tension carrier zone are advantageously connected together in series and the tension carrier zones of a pair are respectively connected to form a half bridge.

Alternatively, the elevator support means comprises several tension carriers and these several tension carriers are divided up into four or into quarter groups or double pairs of tension carrier zones. The tension carriers of a tension carrier zone are again respectively connected together in series and the quarter groups of tension carrier zones are respectively connected to form a full bridge.

Obviously, several half bridges or full bridges of that kind can be formed for monitoring an elevator support means or the elevator support means of an entire elevator installation.

Bridge circuits are proven circuits, primarily in the detection of resistances. It is possible with this construction to detect and evaluate simple abrupt changes between individual tension carriers or tension carrier zones, since the bridge circuit is a comparison circuit.

The elevator support means is preferably a support belt. The support belt consists of several tension carriers. The tension carriers are surrounded by a preferably electrically insulating casing and spaced apart and electrically insulated from one another. Polyurethane or other plastics materials or rubber, for example, is or are suitable as casing material. The casing can obviously also be of multi-layer or multi-part construction. The tension carriers advantageously consist of a steel strand which is twisted and stranded in known mode and manner from a plurality of wires.

Advantageously, the tension carriers of a respective group are combined to form a support belt of that kind or the tension carriers of a support belt are advantageously divided up into two or four tension carrier zones. The tension carrier zones are advantageously thus composed of tension carriers of an individual support belt.

Alternatively, the tension carrier zones can also be composed of tension carriers of several support belts and all tension carriers, which are, for example, combined from several support means, are correspondingly divided up into two or four tension carrier zones or a multiple thereof. The tension carrier zones or all support belts are thus, according to this embodiment, composed of tension carriers of all support belts of the elevator installation.

The tension carriers of an elevator support means are advantageously brought together to form a single bridge circuit, namely a half bridge or full bridge. Alternatively, the tension carriers of an elevator support means can also be divided up into several bridge circuits.

The elevator support means monitoring device advantageously comprises an evaluating unit which includes the processors, storage media, circuit components, such as bridge resistances, voltage stabilizers, etc., required for the evaluation. The elevator support means monitoring device can be divided up into functional groups which on occasion can also be integrated in an elevator control or constructed separately. The elevator support monitoring device advantageously further includes a connecting device for connection of the tension carrier zones with the evaluating unit.

With the explained connections of support means and tension carriers it is possible to provide constructions, appropriate to requirements, of the elevator support means monitoring device. The support belts can have a single contact at the ends thereof, for example by means of the connecting device, as is illustrated by way of example in our application EP 08169452.3. A monitoring, which is reliable and economic overall, of support means can thus be realized.

The elevator support means monitoring device can be installed in an elevator installation for permanent monitoring of the support means. A continuous monitoring is thus possible. Alternatively, however, a temporary use of the monitoring device is also possible. Thus, by periodic measurement it is possible to ascertain a frequency of the abrupt changes. At the time of a later measurement the newly ascertained frequency can be compared with the previous measurement magnitude and necessary measures can, if required, be determined.

It is particularly advantageous if the evaluation of the abrupt changes takes place with consideration of a travel movement of the elevator car. This is carried out on the basis that a possible breakage of an individual wire in the case of subsequent rolling over a deflecting roller usually in turn produces an abrupt change. In that case, as consequence of the rolling over on many occasions a breakage point is briefly closed up and subsequently separated again. This now takes place on each subsequent rolling over. The location of each breakage can now be localized on the basis of the geometric spacing and arrangement of deflecting rollers and a travel path plot with recognition of the respective position of the car in the shaft and stored. Already registered breakage points can accordingly be ignored in detail evaluation.

It is thus possible to reliably determine, inter alia, a degree of wear of the support means and in the case of need a location of damage accumulations can be identified and analyzed in detail.

Advantageously, the elevator support means monitoring device comprises a breakage monitoring device. This can establish or detect breakage of the tension carrier. This detection is carried out, for example, when the resistance of the relevant elevator support means, the relevant tension carrier or the relevant tension carrier zone is established approximately endlessly or when a current flow in the relevant elevator support means, in the relevant tension carrier or in the relevant tension carrier zone is interrupted or when a balancing voltage of the afore-mentioned half bridge or full bridge reaches a limit voltage value. The elevator support means monitoring device advantageously activates a safety device on detection of breakage of the tension carrier or triggers an appropriate alarm, whereby, for example, the elevator installation after completion of an existing travel command is stopped. Overall safety of the elevator installation can thus be increased. The elevator installation usually employs at least two support belts which, for example, are each provided with approximately twelve individual tension carriers. In the case of failure of an individual one of these, in total, twenty-four tension carriers the installation would immediately move to a disembarkation point and stop there. The use safety is thus additionally improved overall.

Advantageously, a resistance value of the tension carrier is detected on each occasion. The individual resistance of a tension carrier according to experience arises in the course of operational life, since individual wires break and an individual resistance of a tension carrier increases. On the one hand it is now possible to determine a reliable limit resistance and on attainment of this limit resistance replacement of the support means is undertaken. However, it is possible additionally or solely for the change in the resistance value over time [dR/dt] to be evaluated and replacement of the support means to be provided when an increase in the resistance over time, which equally corresponds with accumulation of individual breakages, is ascertained.

The respective limit values are preferably determined for customary support means by way of comparison tests.

DESCRIPTION OF THE DRAWINGS

The invention is explained in more detail in the following by way of exemplifying embodiments in conjunction with the schematic figures, in which:

FIG. 3 shows a first example of an elevator support means, FIG. 4 shows a further example of an elevator support means, FIG. 5 shows a first example of arrangement of an elevator support means monitoring device, FIG. 6 shows a further first example of arrangement of an elevator support means monitoring device.

DETAILED DESCRIPTION OF THE INVENTION

Figure 1:
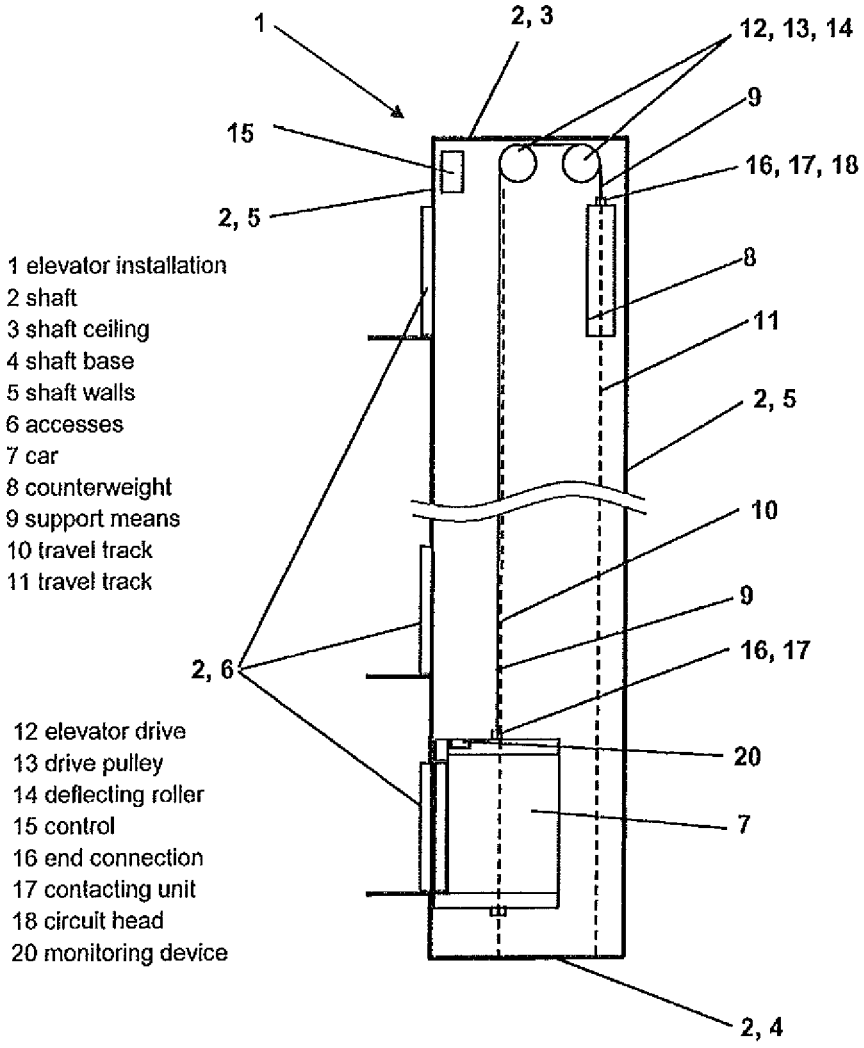
FIG. 1 shows an overall view of an elevator installation with a car with 1:1 suspension.

The same reference numerals are used in all figures for equivalent components.

A possible first overall arrangement of an elevator installation with an elevator support means monitoring device is illustrated in FIG. 1. The elevator installation 1 illustrated there is installed in a shaft 2. The shaft 2 is bounded by shaft walls 5, a shaft ceiling 3 and a shaft base 4. A car 7 and a counterweight 8 are installed in the shaft 2. The car 7 and the counterweight 8 are respectively guided by an associated car travel track 10 and counterweight travel track 11 and are connected together by way of an elevator support means 9 in such a manner that the car 7 and the counterweight 8 can move in opposite sense in the shaft. In the illustrated example the support means 9 is driven by an elevator drive 12, which is arranged in the region of the shaft ceiling 3, with a drive pulley 13. The elevator support means 9 is connected by way of a support means end connection 16 with the car 7 or the counterweight 8. The car 7 can be moved in the shaft 2 along the shaft walls 5 by the drive 12. Accesses 6 are arranged in at least one of the shaft walls 5. The drive is so controlled by a control 15 that the car stops at respectively desired accesses 6 so as to enable entry to, loading of and/or corresponding departure from or unloading of the car 7.

The elevator installation illustrated in FIG. 1 has direct, or 1:1, suspension. This means that a circumferential speed of the drive pulley 13 directly corresponds with the travel speed of the car 7.

In this example the support means end connection 16 on the counterweight side is provided with a contacting unit 17. Electrically conductive, individual tension carriers of the elevator support means 9 are in this example electrically contacted by this contacting unit 17. Directly mounted on this contacting unit 17 is a circuit head 18 which interconnects individual tension carriers of the elevator support means so that a desired circuit arises.

A support means end connection 16 on the car side is similarly provided with a contacting unit 17, which enables connection of the elevator support means with an elevator support means monitoring device 20. The elevator support means monitoring device 20 includes a corresponding connecting device, for example in the form of terminal clips or plug strips. The elevator support means monitoring device 20 is additionally connected with the control 15. This connection can be effected by means of a bus system, wireless or conventional wiring technology. In the example the elevator support means monitoring device 20 is arranged in the vicinity of the support means end connection 16 on the car side.

The embodiment according to FIG. 1 where a circuit head 18 is employed on the counterweight side is advantageously used in the case of elevator systems with 1:1 suspension since in that case the connecting of the tension carriers with the counterweight takes place directly and accordingly no connecting lines going out from the counterweight are required.

Figure 2:
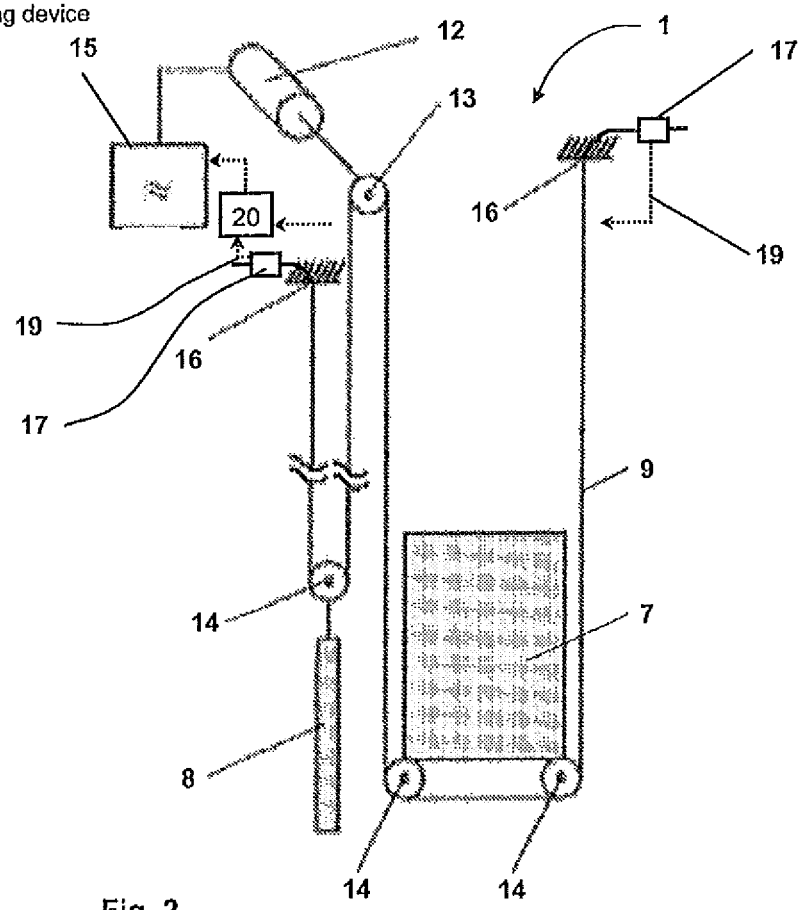
FIG. 2 shows a schematic view of an elevator installation with car with 2:1 suspension.

Another possible overall arrangement of an elevator installation with an elevator support means monitoring device is illustrated in FIG. 2. In this variant of embodiment the elevator installation has 2:1 suspension. This means that a circumferential speed of the drive pulley 13 corresponds with twice the value of the travel speed of the car 7. By contrast with the embodiment according to FIG. 1 in this example the elevator support means 9 is fastened in the shaft at its two ends with use of support means end connections 16 and the elevator support means 9 is connected with car 7 and counterweight 8 by way of supporting or deflecting rollers 14. According to this embodiment the two ends of the support means are again provided with contacting units 17, but the two contacting units 17 or the two ends of the elevator support means 9 are connected with the elevator support means monitoring device 20 by way of connecting lines 19. The requisite connections are undertaken in the elevator support means monitoring device 20. The elevator support means monitoring device 20 is in turn again connected with the control 15 of the elevator installation 1.

The elevator support means monitoring device 20 is usually permanently installed in the elevator installation 1 and constantly monitors the elevator support means 9. Obviously, however, it can also be temporarily mounted in the elevator installation for use only in time windows defined in terms of time. In this regard, with advantage possible contacting units 17 are left in the elevator installation 1 and merely the elevator support means monitoring device 20 is temporarily inserted and removed again. Thus, several installations can be monitored by one elevator support means monitoring device 20.

FIG. 3 and FIG. 4 show typical elevator support means 9 such as are usable in the elevator installations according to FIG. 1 or 2. FIG. 3 shows a belt-like support means 9 provided with six parallel tension carriers 21. The tension carriers 21 consist of a stranded arrangement of steel wires 23. The tension carriers are embedded in a casing material 22, which casing 22 keeps the individual tension carriers 21 at a spacing from one another and insulates them from one another and from the environment. The illustrated belt has on one side traction grooves which enable good transmission of traction forces and which at the same time guide the belt and it has on the opposite side a planar closure surface with a thin material layer. The illustrated belt contains six individual tension carriers 21. Other embodiments of belts contain, for example, twelve tension carriers.

FIG. 4 shows another embodiment of an elevator support means 9. This support means 9 contains four parallelly extending tension carriers 21. The tension carriers 21 are also surrounded by a casing 22, wherein the casing 22 has an upper casing half 22.1 and a lower casing half 22.2. The two casing halves are produced from, for example, different materials, wherein, for example, the upper casing half 22.1 consists of a material with a high traction capability whilst the lower casing half 22.2 consists of a sliding material. Here, as well, the casing keeps the individual tension carriers 21 at a spacing from one another and insulates them relative to the environment.

In the examples, the tension carriers 21 are arranged parallel to one another. Obviously, other arrangements of tension carriers are also possible. Thus, the tension carriers can also be arranged in layers.

As a rule, an elevator installation includes several elevator support means 9 which together carry the elevator car 7. The elevator support means 9 are in that case arranged parallel to one another and thus act as a common support means.

FIG. 5 shows a connection of an elevator support means 9 with the elevator support means monitoring device 20 such as used in the elevator installation according to FIG. 2. The two ends of the elevator support means 9 are equipped with contacting units 17 and the tension carriers 21 of the support means 9 are connected by means of these contacting units 17 with the elevator support means monitoring device 20 via connecting lines 19. The elevator support means monitoring device 20 has a connection with the control 15. Thus, if required the elevator installation is, for example, stopped or an operational state of the elevator installation is, for example, also communicated by way of this connection. The elevator support means monitoring device 20 can, for example, therefore use the actual operating time for evaluation.

By contrast, FIG. 6 shows a connection of an elevator support means 9 with the elevator support means monitoring device 20 such as used in the elevator installation according to FIG. 1. The two ends of the elevator support means 9 are again equipped with contacting units 17. One contacting unit 17 is in this regard furnished with a circuit head 18. The circuit head 18 connects together two respective tension carriers 21 to form a serially connected tension carrier zone. The connection 19 with the elevator support means monitoring device 20 can thereby be reduced to one end of the support means 9.

Figure 12:
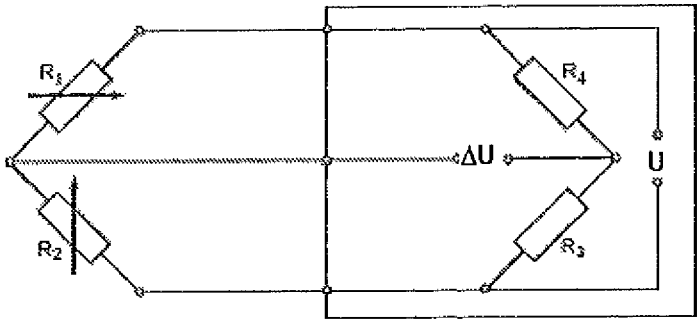
FIG. 12 shows an example of an elevator support means monitoring device with use of a half-bridge circuit.
Figure 13:
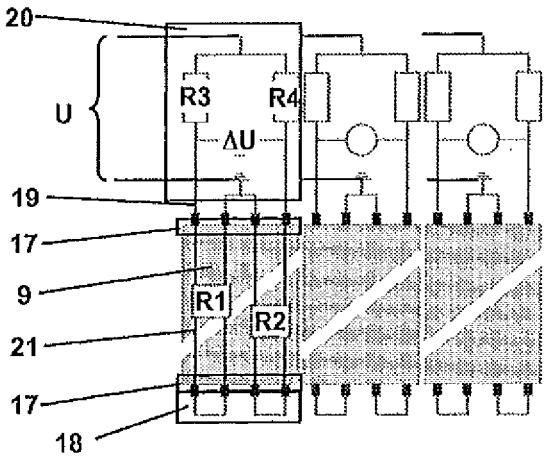
FIG. 13 shows a first circuit example of elevator support means with a half-bridge circuit.
Figure 14:
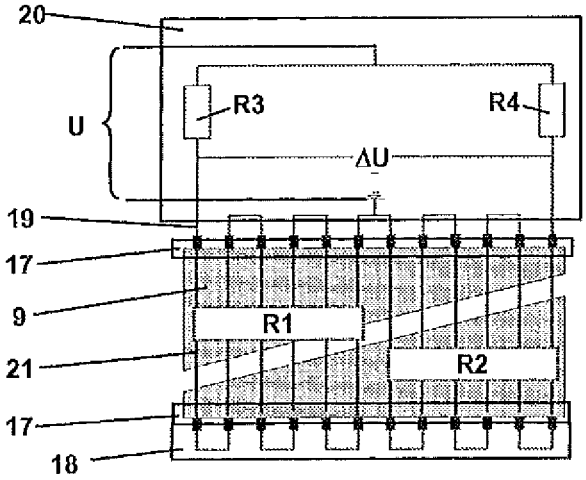
FIG. 14 shows a second circuit example of elevator support means with a half-bridge circuit.

FIG. 12 to FIG. 14 show one possible circuit arrangement for detection of abrupt changes in an electrical resistance in the tension carriers of the elevator support means. In the example according to FIG. 13 three substantially identical elevator support means 9 each with four tension carriers 21 are combined to form a support means unit. A support means unit of that kind is ideally usable in, for example, the elevator installation according to FIG. 1. The support means 9 used correspond with, for example, the support means as illustrated in FIG. 4.

One end of the support means 9 is respectively provided with a contacting unit 17, and a switching or circuit head 18, which in each instance combines two tension carriers to form a tension carrier zone, is connected with this contacting unit 17.

These two tension carrier zones each define a resistance R1 or R2. Each of the support means 9 in the example according to FIG. 13 thus includes two respective tension carrier zones to form two respective tension carriers 21 connected in series. The other ends of the support means 9 are similarly each provided with a respective contacting unit 17, which units enable connection of the support means or the tension carriers thereof with the elevator support means monitoring device 20. In this regard, in the illustrated example in each instance the two tension carrier zones of a support means are now connected together, as resistances R1 and R2 to be compared in the elevator support means monitoring device 20, to form a half bridge as illustrated in FIG. 12 in schematic view. Half bridge means that merely two tension carrier zones are measured in comparison with one another, and for completion of a measuring bridge stationary reference resistances R3 and R4 are inserted into the elevator support means monitoring device 20.

In the exemplifying embodiment according to FIG. 13 each of the support means 9 is equipped with an individual measuring bridge. This gives the advantage that each support means can be considered individually.

In the example according to FIG. 14, thereagainst, a support means 9 with twelve tension carriers is used. These twelve tension carriers 21 are respectively connected together in pairs at one end of the support means and the other end of the support means is connected in such a manner that two symmetrical tension carrier zones arise, which then define an associated resistance R1 or R2. A measuring bridge arrangement is then constructed as already explained in the description with respect to FIG. 12. Obviously several support means of that kind can also be connected to form a support means unit.

Figure 15:
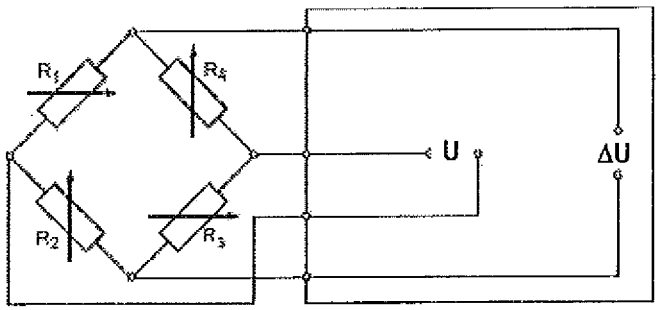
FIG. 15 shows an example of an elevator support means monitoring device with use of a full-bridge circuit.
Figure 16:
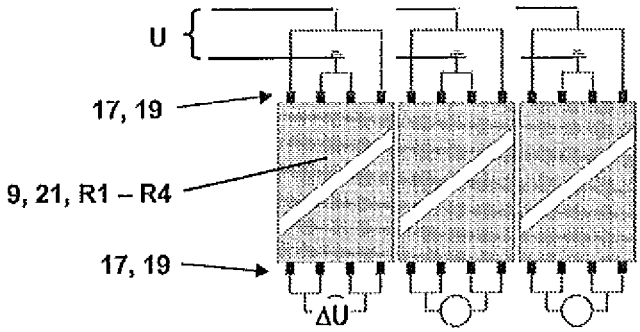
FIG. 16 shows a first circuit example of elevator support means with a full-bridge circuit and FIG. 17 shows a second circuit example of elevator support means with a full-bridge circuit.
Figure 17:
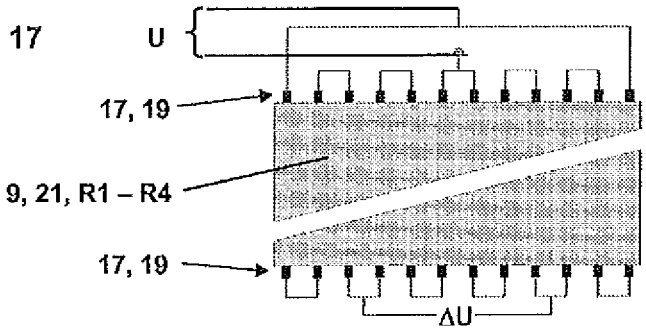

FIG. 15 to FIG. 17 show another possible circuit arrangement for detection of abrupt changes in an electrical resistance in tension carriers of the elevator support means. In the example according to FIG. 16 again three substantially identical elevator support means 9 each with four tension carriers 21 are combined to form a support means unit.

The two ends of the support means 9 are each provided with a respective contacting unit 17. The four tension carriers each form an individual tension carrier zone and each of these tension carrier zones defines a respective resistance R1 to R4. Each of the support means 9 in the example according to FIG. 15 thus includes four tension carrier zones each with one tension carrier 21. The ends of the support means 9 are connected by way of contacting units 17 and connecting lines 19 with the elevator support means monitoring device 20. In this regard, in the illustrated example the four tension carrier zones of a support means are, as resistances R1 to R4 to be compared in the elevator support means monitoring device 20, now connected together to form a full bridge as also illustrated in FIG. 15 in schematic view. Full bridge means that four tension carrier zones or the resistances R1 to R4 thereof are measured in comparison with one another. A deviation in one of the tension carriers causes an imbalance in the measurement bridge, which can be correspondingly evaluated.

In the exemplifying embodiment according to FIG. 16 each of the support means 9 is equipped with an individual measuring bridge. This also gives here the advantage that each support means can be considered individually.

By contrast, in the example according to FIG. 17 a support means 9 with twelve tension carriers is used. The support means is illustrated with a construction substantially as illustrated in FIG. 3, wherein instead of the six tension carriers shown there, twelve thereof are used. These twelve tension carriers 21 are divided up into four tension carrier zones, wherein then each tension carrier zone contains three tension carriers connected in series. These four tension carrier zones now respectively define a corresponding resistance R1 to R4. A measuring bridge arrangement is then constructed as already explained in the description with respect to FIG. 16. Obviously also more support means of that kind can here be connected to form a support means unit. This circuit arrangement with support means ends connected at both ends is preferentially employed in the elevator installation according to FIG. 2. An expert can select the suitable circuit arrangement in dependence on the form of suspension of the car and the counterweight as well as the number of support means and tension carriers used.

Figure 7:
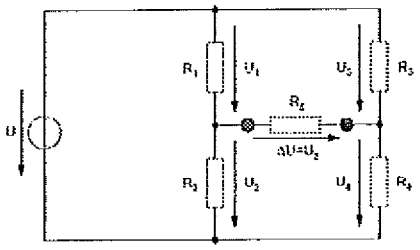
FIG. 7 shows an example of a bridge circuit.

FIG. 7 shows a principle of a measuring bridge such as is used for ascertaining abrupt change in the characterizing property of one of the tension carriers. The characterizing property in the illustrated example is an electrical resistance of a tension carrier. The measuring bridge consists of four resistances R1 to R4, such as tension carrier zones as explained in the preceding examples, or in the case of use of a half bridge can be tension carrier zones and reference resistances. A voltage U is applied to the measuring bridge. A resulting measurement voltage ΔU is determined by the balance state of the four resistances R1 to R4. If one of the four resistances R1 to R4 changes, the resulting measurement voltage ΔU changes correspondingly.

Figure 8:
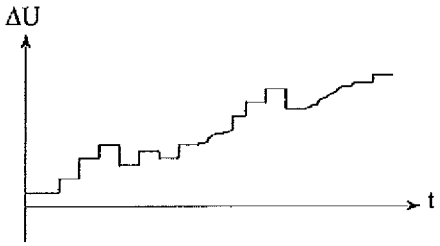
FIG. 8 shows a measurement example of a bridge voltage measurement.
Figure 9:
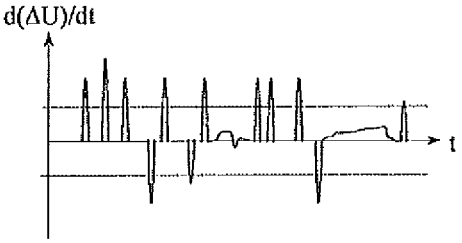
FIG. 9 shows an example for ascertaining abrupt changes.
Figure 10:
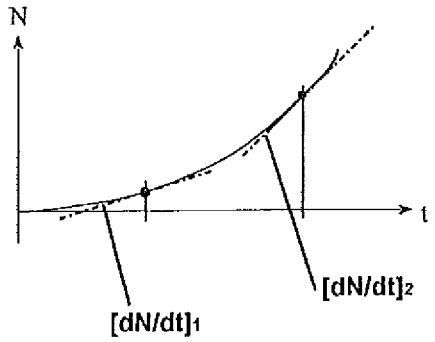
FIG. 10 shows an analysis of an evaluation result.

FIG. 8 shows a corresponding measurement cycle. In this connection, the resulting measurement voltage ΔU is recorded over time t. The actual operating time of the elevator installation or if need be a time window is taken as time t. A change in the resulting measurement voltage ΔU takes place, for example, if as a consequence of material fatigue or the action of a force an individual wire 23 of a tension carrier 21 breaks. This has the consequence of a substantially abrupt change in one of the resistances R1 to R4 in correspondence with the tension carrier zone concerned. As a consequence thereof the resulting measurement voltage ΔU changes. This change is illustrated in FIG. 8, wherein depending on the tension carrier concerned a positive or a negative change takes place. This time plot of the resulting measurement voltage ΔU is derived in accordance with time t, i.e. d(ΔU)/dt, whereby the abrupt changes in terms of time are clearly visible as illustrated in FIG. 9. The instances which fall below or exceed a critical step value are counted as a breakage of a wire. The numbers N of breakages are in turn stored in their time sequence and added up, as illustrated in FIG. 10. If the sum N of the registered breakages exceeds a critical breakage total number then, for example, a corresponding warning signal is set in the control 15. In addition, a frequency dN/dt is ascertained in an evaluating unit of the elevator support means monitoring device 20. An increase in the frequency indicates that a constant loading limit has been reached. In addition, the change in frequency dN/dt/dt can also be evaluated. An increase in this value beyond a critical limit is a further indication that the support means has to be replaced.

In a refinement the bridge circuit is provided with a limit value check, which can detect a complete failure or a breakage of a tension carrier zone or a tension carrier. A failure of that kind produces a correspondingly large resultant measurement voltage ΔU, since a resistance of the tension carrier zone concerned arises without end. The limit value check recognizes this state and can immediately stop the elevator installation or if required after finishing an existing travel command.

Figure 11:
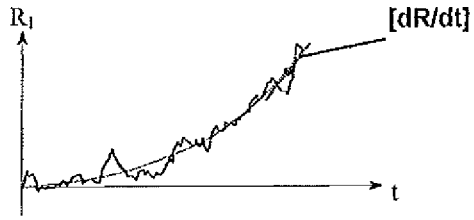
FIG. 11 shows an alternative analysis of a measurement result.

FIG. 11 shows an alternative or supplementing evaluating system. In this regard, a resistance of a tension carrier zone is detected and the derivation dR/dt thereof is stored. This value is compared with a resistance change considered to be acceptable. As soon as this value considered to be acceptable is exceeded, the elevator installation is, for example, stopped or a maintenance report is issued.

Tension carriers have the property that with increasing ageing of the material a frequency of breakage of wires increases. The present evaluating system uses this property in that an increase is made recognizable by the measurement magnitude dR/dt.

With knowledge of the present invention the elevator expert can change the set forms and arrangements as desired. For example, the expert can set different warning steps which are usually determined as results of series of tests.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method of monitoring an elevator support comprising the steps of:

monitoring at least one characterizing property of the elevator support with an elevator support monitoring device connected with the elevator support;

detecting an abrupt change in the at least one characterizing property with the elevator support monitoring device; and determining a state of the elevator support with the elevator support monitoring device by evaluation of a plurality of successive ones of the abrupt change in the characterizing property.

2. The method according to claim 1 wherein the step of determining the state of the elevator support is performed by at least one of a sum of the plurality of abrupt changes in the at least one characterizing property, a frequency of the successive abrupt changes in the at least one characterizing property, and a change in the frequency of the successive abrupt changes in the at least one characterizing property.

3. The method according to claim 1 further including at least one of the steps of:

calling up in the elevator support monitoring device the determined state of the elevator support;

indicating the determined the state of the elevator support with the elevator support monitoring device;

communicating the determined state of the elevator support from the elevator support monitoring device to a central elevator control; and on attainment of a limit value of the determined state triggering an alarm or activating a safety device.

4. The method according to claim 1 wherein the abrupt change in the at least one characterizing property is detected as a relative change between the elevator support and another elevator support or as a relative change between a first and a second tension carrier of the elevator support.

5. The method according to claim 1 wherein an electrical resistance of the elevator support or of a tension carrier of the elevator support is the at least one characterizing property.

6. The method according to claim 5 including filtering the successive abrupt changes by grounding ends of the elevator support or a tension carrier of the elevator support with a grounding resistance which is high in value by comparison with an internal resistance of the elevator support or the tension carrier.

7. The method according to claim 1 wherein the elevator support includes a plurality of tension carriers and further including the steps of:

dividing the plurality of tension carriers into two tension carrier zones;

connecting the tension carriers of each of the tension carrier zones together in series and comparing the at least one characterizing property these two tension carrier zones with one another; and counting the abrupt changes in a difference between the at least one characterizing property of the compared tension carrier zones.

8. An elevator support monitoring device for monitoring an elevator support comprising:

a connecting device connecting the elevator support monitoring device with an elevator support; and a device for detecting and evaluating a characterizing property of the elevator support or a tension carrier of the elevator support, the detecting and evaluating device detecting an abrupt change in the characterizing property and determining a state of the elevator support by evaluation of a plurality of successive ones of the abrupt change in the characterizing property.

9. An elevator installation with the elevator support monitoring device according to claim 8 including:

an elevator car;

a counterweight connected to the elevator car by the elevator support;

an elevator drive engaging the elevator support to raise and lower the counterweight and the elevator car;

the elevator support including at least one tension carrier that transmits tension forces from at least one of the elevator drive and the counterweight to the elevator car; and at least one end of the elevator support being connected by the connecting device with the elevator support monitoring device.

10. The elevator installation according to claim 9 wherein the elevator support or the at least one tension carrier includes electrically conductive wires that are combined into a wire bundle and which transmit tension forces and the characterizing property is an electrical resistance of the wires.

11. The elevator installation according to claim 9 wherein the elevator support includes a plurality of the at least one tension carrier and the tension carriers are divided into paired tension carrier zones and the tension carriers of each of the tension carrier zones are connected together in series and the tension carrier zones of each pair are connected to form a half bridge.

12. The elevator installation according to claim 9 wherein the elevator support includes a plurality of the at least one tension carrier and the tension carriers are divided into double pairs of tension carrier zones and the tension carriers of each of the tension carrier zones are connected together in series and the double pairs of the tension carrier zones are connected to form a respective full bridge.

13. The elevator installation according to claim 9 wherein the elevator support or the at least one tension carrier includes electrically conductive wires that are combined into a wire bundle and which transmit tension forces and the characterizing property is an electrical resistance of the wires, the elevator support monitoring device includes a breakage monitoring device for detecting a breakage of the at least one tension carrier, and the elevator support monitoring device on detection of a breakage of the at least one tension carrier activates a safety device, and wherein the breakage of the at least one tension carrier is detected when:

an electrical resistance of the elevator support, the at least one tension carrier or a tension carrier zone of the elevator support is detected as approximately infinite; or a current flow in the elevator support, the at least one tension carrier or the tension carrier zone is interrupted; or a balancing voltage of a half bridge or a full bridge including the at least one tension carrier reaches a limit voltage value.

14. The elevator installation according to claim 13 wherein the breakage monitoring device is a separate component of the elevator support monitoring device and is integrated as a fixed component in the elevator installation.

15. The elevator installation according to claim 9 wherein the elevator support monitoring device is permanently installed in the elevator installation and constantly monitors the characterizing property of the elevator support means and continuously evaluates and detects the abrupt changes in the characterizing property.

16. The elevator installation according to claim 9 wherein the elevator support monitoring device is adapted for temporary use in the elevator installation and monitors the characterizing property of the elevator support in continuing time windows and evaluates and detects the abrupt changes in the characterizing property in the time windows or over a plurality of the time windows.

17. The elevator installation according to claim 16 wherein the elevator support monitoring device selects a critical time window and determines a state of the elevator support utilizing a sum of the abrupt changes in the characterizing property within the critical time window and the critical time window is the one of the time windows with a greatest number of the abrupt changes in the characterizing property.

* * * * *